US005823406A

United States Patent [19]

Roberts

[11] Patent Number: 5,823,406

[45] Date of Patent: Oct. 20, 1998

[54] MOBILE VOLUME FLOW FILLING UNIT

[75] Inventor: Terence P. Roberts, Burnsville, Minn.

[73] Assignee: Neupak, Inc., St. Paul, Minn.

[21] Appl. No.: 629,348

[22] Filed: Apr. 8, 1996

[51] Int. Cl.[6] ..... F04B 17/06

[52] U.S. Cl. ..... 222/626; 222/135; 222/309; 222/334; 222/389; 141/104

[58] Field of Search ..... 222/129, 135, 222/608, 626, 628, 309, 334, 389; 141/102, 104

[56] References Cited

U.S. PATENT DOCUMENTS

| | | | |
|---|---|---|---|
| 2,501,004 | 3/1950 | Reese | 222/626 |
| 3,194,438 | 7/1965 | Walker et al. | 222/608 X |
| 4,305,437 | 12/1981 | Greene | 141/59 |
| 4,411,295 | 10/1983 | Nutter | 141/59 |
| 4,434,820 | 3/1984 | Glass | 222/309 X |
| 4,641,693 | 2/1987 | Rakucewicz | 141/98 |
| 4,651,788 | 3/1987 | Grosskreuz et al. | 141/83 |
| 5,080,148 | 1/1992 | Florida | 222/309 X |
| 5,105,859 | 4/1992 | Bennett et al. | 141/102 |
| 5,542,574 | 8/1996 | Stern | 222/309 X |
| 5,605,252 | 2/1997 | Owen et al. | 222/135 X |

FOREIGN PATENT DOCUMENTS

| | | | |
|---|---|---|---|
| 2343399 | 9/1997 | France | 222/309 |

*Primary Examiner*—Joseph Kaufman
*Attorney, Agent, or Firm*—Palmatier, Sjoquist, Helget & Voigt, P.A.; Nelson R. Capes, Esq.

[57] ABSTRACT

A mobile filling unit mounted on a wheeled base and having one or more pumping systems and liquid dispensing heads. Each of the pumping systems has a metering turret containing a number of adjustable rods, the rods being adjustable to limit the stroke of a reciprocable drive motor, the drive motor being directly connected to a reciprocable pump, so that the volume delivered by the pump is controllable to any of a number of predetermined values equal to the respective settings of the adjustable rods in the metering turret.

15 Claims, 6 Drawing Sheets

MOBILE VOLUME FLOW FILLING UNIT

BACKGROUND OF THE INVENTION

The present invention relates generally to devices for the filling of containers in a manufacturing or industrial processing plant. More particularly, the invention relates to a mobile volume flow filling device which may be wheeled to adjacent an assembly or processing line conveyor for the purpose of filling containers passing along the conveyor, and which may be quickly disconnected and removed from its position to allow for other processing equipment to be moved into its position.

The invention is related to the invention described in U.S. Pat. No. 5,505,233, issued Apr. 9, 1996, entitled "Container Filling Unit." The prior application discloses a mobile filling unit which dispenses liquids on the basis of weight by using load cells in conjunction with portable multiple filling heads mounted in a manner similar to the present invention.

The mobile volume flow filling unit is movable from a container filling position to a cleaning location and to a non-use or a ready-to-use location. It is particularly adaptable for the measured dispensing of paints to containers on a filling line, where the unit may be dedicated to dispensing paint of a particular color; and when the filling line is changed over to fill containers of a different color paint, the unit may be moved away and replaced by another mobile filling unit dedicated to dispensing the new color. When the unit is inactive it may be moved to a cleaning location where the flow lines and valves may be cleaned and prepared for a subsequent period of use. The cleaning location may also provide a convenient waste disposal site for removal of waste materials associated with the cleaning process.

It is a principal object of the invention to provide a mobile and portable dispensing apparatus for use in filling a plurality of containers and which may be portably moved to either a container filling location or a cleaning location.

It is another object of the invention to provide a mobile filling unit which may be quickly and easily connected and disconnected to a source of liquid to be dispensed and to the source of power to drive the unit.

It is another object of the invention to preferably provide a mobile filling unit with a plurality of dispensing heads which are mounted to a single adjustable mast for positioning over a container conveyor for simultaneously filling more than one container.

The foregoing objects and other objects and advantages will become apparent from the accompanying specification and drawings and with reference to the drawings.

SUMMARY OF THE INVENTION

The present invention comprises one or more dispensing heads mounted to a wheeled cart and connected to a volume flow pumping apparatus such as a reciprocable pump driven by a suitable air motor, both of which are mounted to the same wheeled cart. The dispensing heads are controlled by the position of the pump piston which is directly related to the volume of liquid delivered by the pump. The dispensing heads are located on a vertically-positionable mast, and each dispensing head contains a flow valve actuable by controls connected to monitor pump piston position or the equivalent position of the piston drive shaft.

DESCRIPTION OF THE PREFERRED EMBODIMENT

Figure 1:
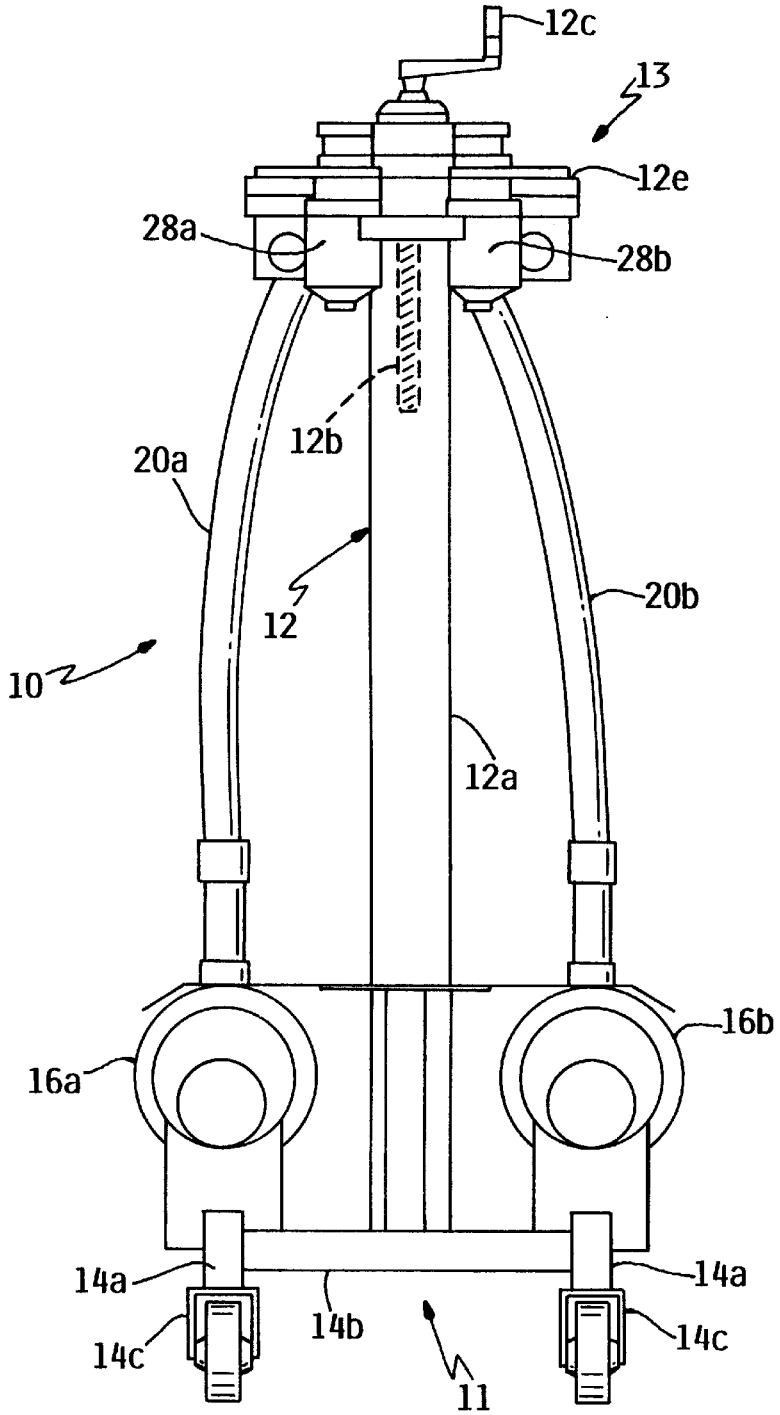
FIG. 1 is a front elevation of the container filling unit embodying the concepts of the applicants' invention.

In accordance with the accompanying drawings, the container filling and flushing unit is generally designated 10 and basically includes a wheeled, mobile base 11, a vertically adjustable mast section 12 supported and carried by base 11 and a distributing and dispensing portion designated in its entirety 13.

Obviously, a prime function of the unit is to provide complete mobility of the unit 10 for transport between a container filling location and a flushing, cleaning location which is remote from the filling location to prevent contamination of the filling area with cleaning solvents.

In the form shown, the mobile base 11 includes a framework having side rails 14*a*—14*a* and at least one cross member 14*b*. Wheeled carriers 14*c* are provided at the ends of side rails 14*a*.

Figure 2:
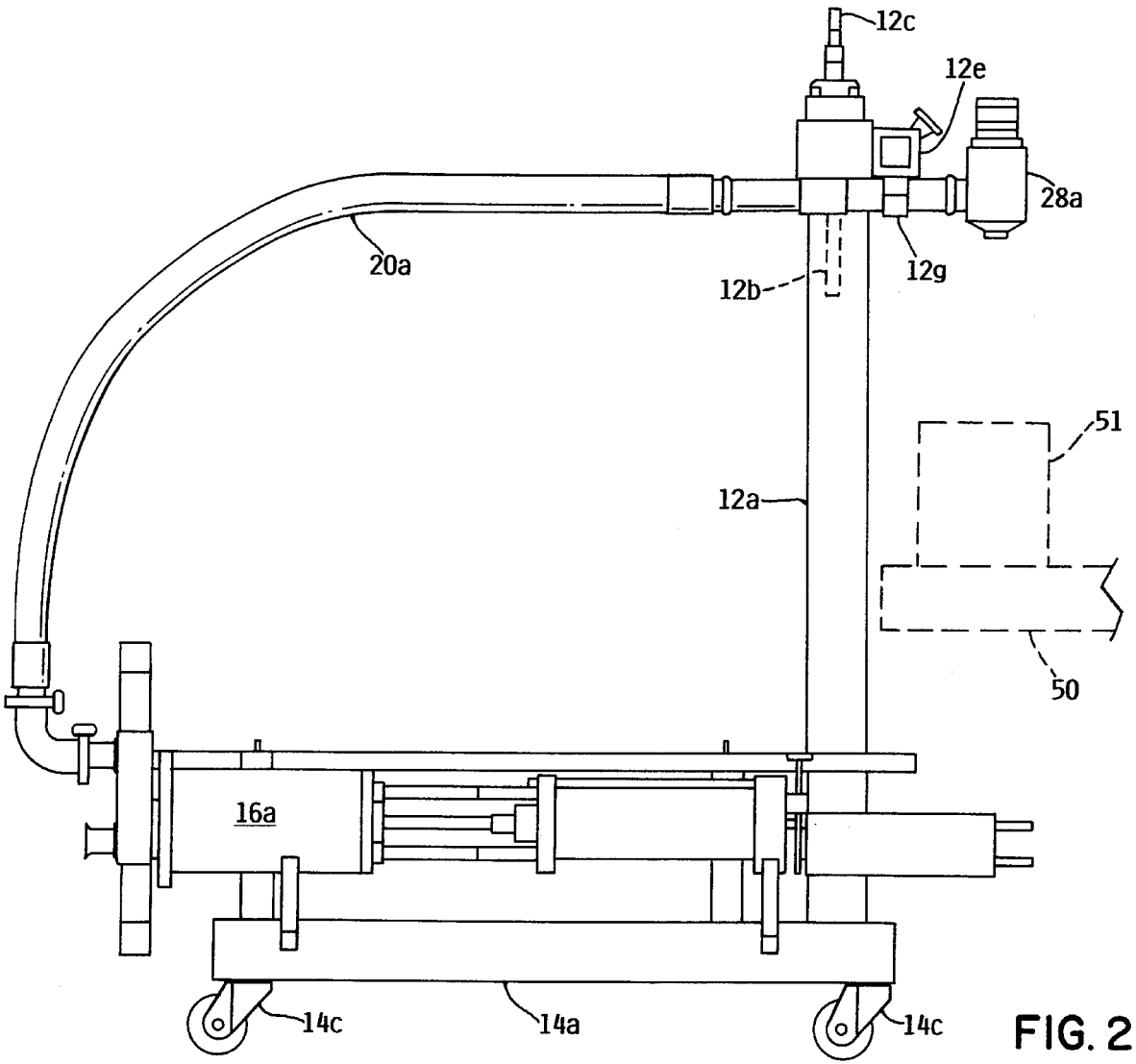
FIG. 2 is a side elevation thereof.

Mast section 12 includes a vertically extending, tubular member 12*a* having a threaded rod 12*b* therein with a handle member 12*c* secured to the rod 12*b* for rotation thereof which will obviously result in vertical positioning of the distributing and dispensing portion 13 which is carried by a horizontal mounting bar 12*e*. Horizontally shiftable carriers 12*f* are provided on bar 12*e*. As illustrated in FIG. 2, flow line carrier clamp devices 12*g* are provided below the carriers 12*f* and horizontal bar 12*e*. As illustrated, two such carriers are provided for a dual flow line arrangement but this number may vary with the number of filling lines of any one unit.

It should be obvious that various forms of vertically shifting of the dispensing and distribution portion 13 with respect to the floor and with respect to the containers may be provided. The vertical adjustability of the distribution portion will also allow for positioning the final material discharger end of the unit above or below the surface of the material within the container.

Figure 3:
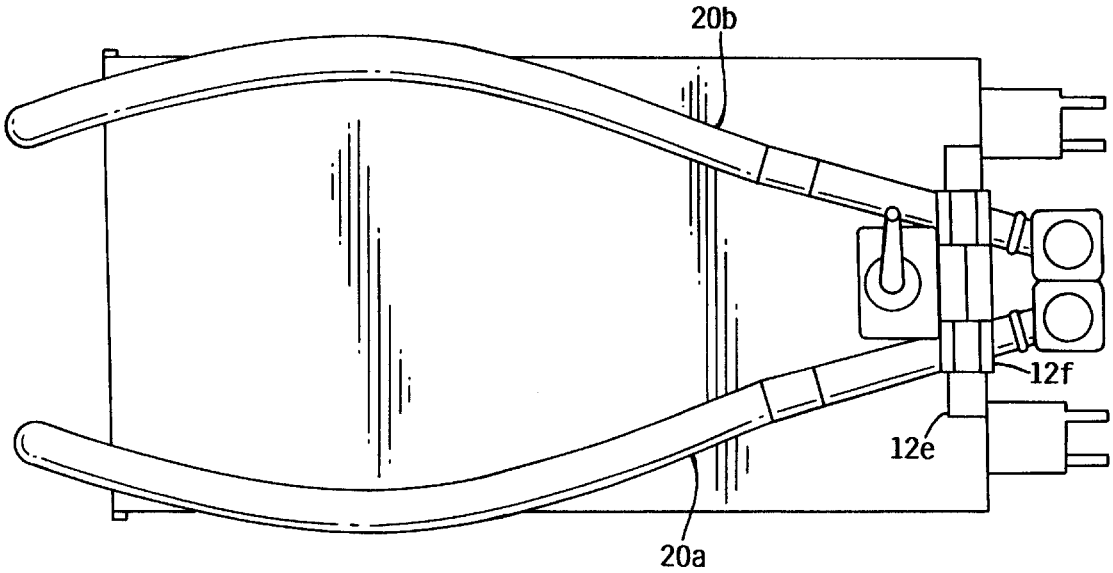
FIG. 3 is a top plan view thereof.

As illustrated in FIGS. 1–3, and in the form of operation selected for description, a hose 20*a* is provided to convey material from a pump 16*a,* and a hose 20*b* is provided to convey material from a pump 16*b*. These figures show an illustrative system for simultaneously filling a pair of containers. For more containers, the number of pumps and hoses is increased.

A solenoid-actuated dispenser valve 28*a* is connected to the end of delivery hose 20*a,* for dispensing liquid downwardly into a container position beneath the valve. Similarly, a dispenser valve 28*b* is connected to the delivery hose 20*b* for dispensing liquid to a container position beneath the valve. Reciprocable pump 16*a* and 16*b* respectively deliver liquid to the hoses 20*a* and 20*b* in measured volumes according to the apparatus and techniques hereinafter described. The reciprocable pump 16*a,* 16*b* may be either single-acting pumps or double-acting pumps; i.e., they may deliver liquid either during a single stroke of the pump or during both the forward and rearward pump strokes. The reciprocable pumps are known in the art, as are the solenoid-actuated dispenser valves.

FIG. 2 shows a table or conveyor 50 in dotted outline, illustrating a representative position of the container filling unit in one operating position. A typical container 51 is also shown in dotted outline, positioned beneath the dispenser nozzle 28*a*.

Figure 4:
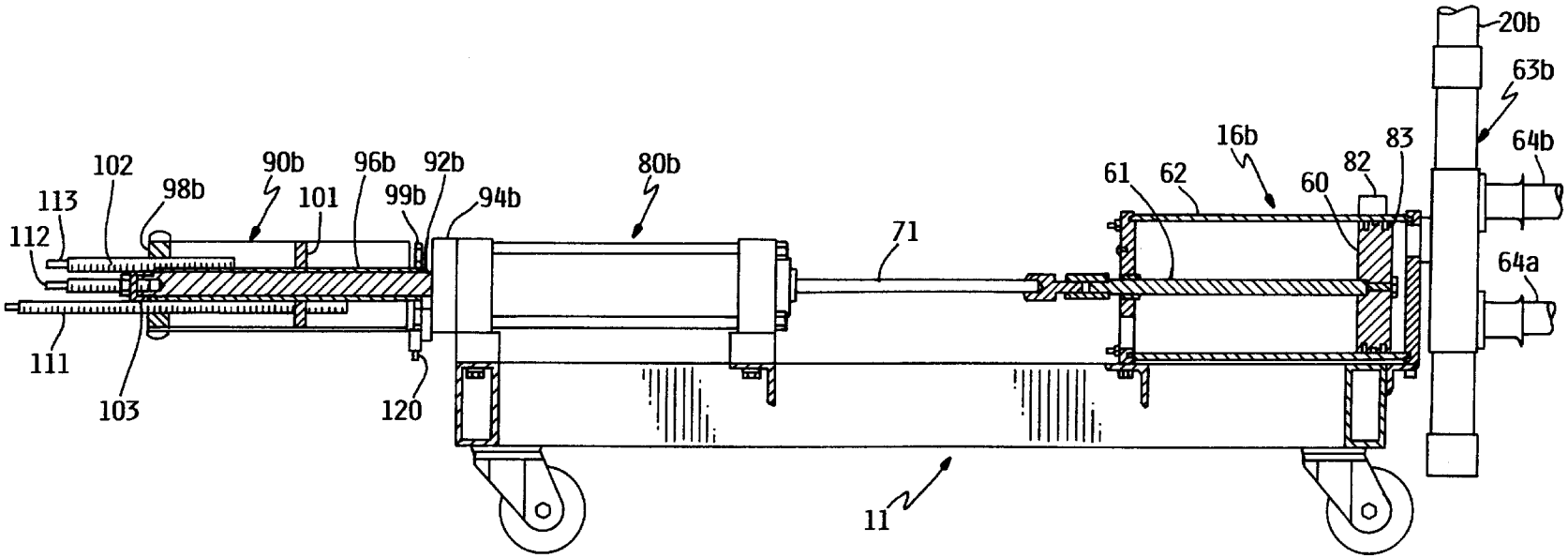
FIG. 4 is a side elevation view of the pump and metering system in partial cross section.

FIG. 4 shows a side elevation view, in partial cross section, of the fluid delivery portion of the invention. Pump 16*b* is shown in cross-section view, illustrating a piston 60 which is reciprocable within a cylinder 62, and is driven by piston rod 61. A valve assembly 63*b* is connected to pump 16*b*, valve assembly 63*b* having an intake port 64*b* for receiving liquid from a liquid source (not shown), and an outlet valve for delivering liquid out to hose 20*b*. The intake and exhaust valves within valve housing 63*b* are conventional in form and design, and are well known in the art. Piston 60 is shown at a position corresponding to the beginning of the intake stroke of pump 16*b*. Piston rod 61 is moved by action of a connecting rod 71 which is connected to an air motor 80*b* of conventional design. Air motor 80*b* is a reciprocable air motor which is driven by a source of pressurized air and valves (not shown) for providing the reciprocating energy. A metering turret 90*b* is attached adjacent one end of air motor 80*b* for providing the metering control of the liquid delivered by pump 16*b*.

A proximity sensor 82 is affixed to pump cylinder 62 and has a sensor element which is responsive to the presence of a magnetic field. Pump cylinder 60 has a circumferential magnet 83, and the signal generated by magnet 83 is detected by proximity sensor 82 whenever piston 60 reaches the end of its forward stroke. The signal generated by proximity sensor 82 is sent to a solenoid actuator to reverse the stroke of air motor 80*b*. This causes air motor 80*b* to reciprocate in the opposite direction and thereby to pull the piston 60 through a suction stroke for the pump. A signal from proximity sensor 82 can also be used to actuate the solenoid valve 28*a* to stop the dispenser nozzle from dispensing liquid.

Figure 5:
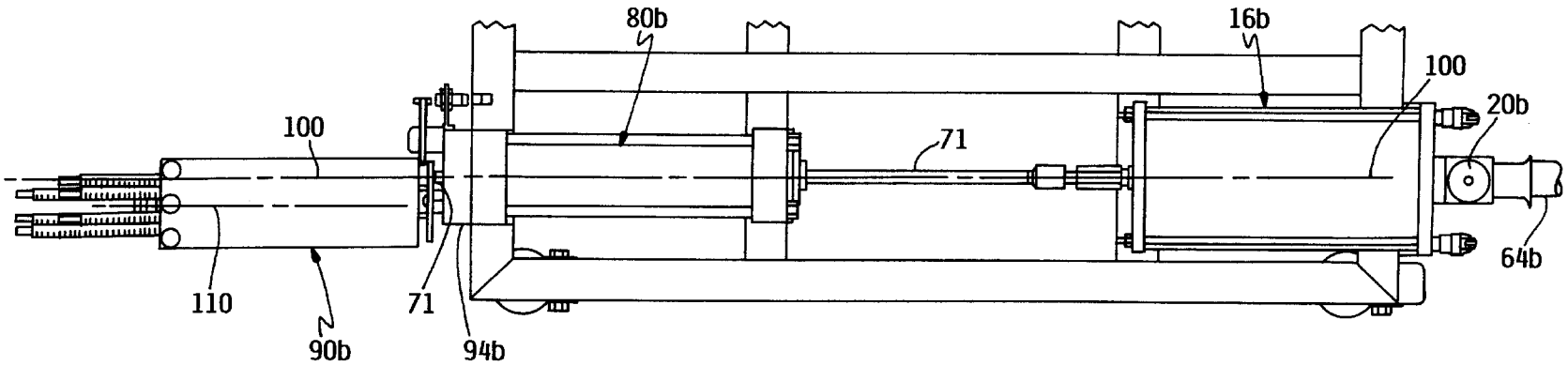
FIG. 5 is a top plan view thereof.

FIG. 5 shows a top view of the partial assembly including pump 16*b*, air motor 80*b*, and metering turret 90*b*. The piston rod 61, connecting rod 71, and air motor 80*b* are aligned along a common axis 100. The alignment axis 110 of metering turret 90*b* is offset from axis 100 in the horizontal plane, but is in alignment with axis 100 in the vertical plane. The description herein is made with reference to pump 16*b* and its associated components; it is understood that pump 16*a*, and other pumps which may form a part of the container filling unit 10, are identically constructed.

Figure 6:
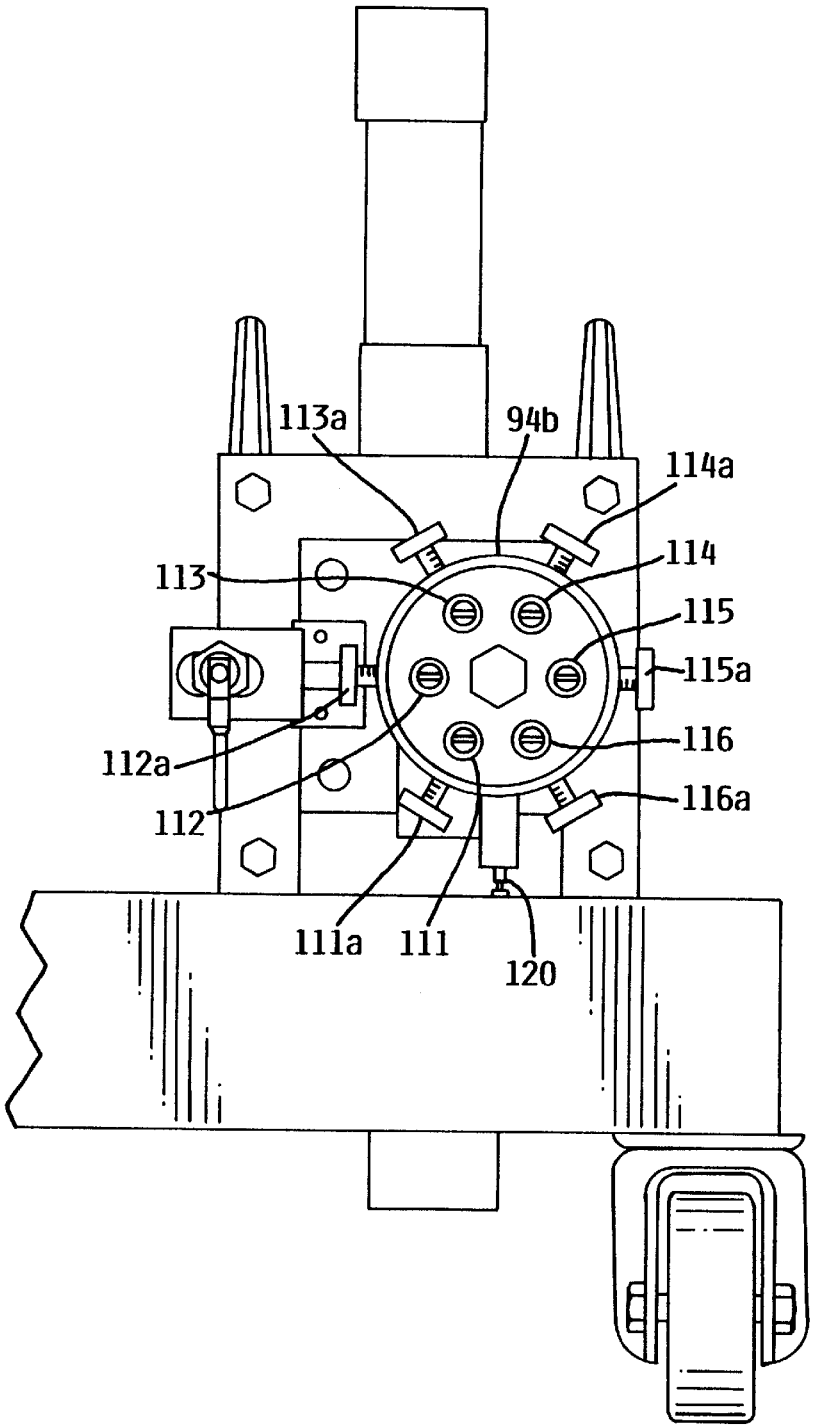
FIG. 6 is a partial end view thereof.

A construction of metering turret 90*b* is best understood with reference to FIGS. 4–6. Metering turret 90*b* is mounted on a central shaft 92*b* which is affixed adjacent air motor 80*b* by a plate 94*b*. A rotatable sleeve 96*b* is coaxially aligned about shaft 92*b*, and an end plate 98*b* is affixed proximate the outermost end of sleeve 96*b*. A detent plate 99*b* is affixed proximate an interior end of sleeve 96*b*. Sleeve 96*b*, end plate 98*b*, and detent plate 99*b* are rotatable in coincidence about shaft 94*b*; sleeve 96*b* is supported proximate the center of metering turret 90*b* by a spacer 101. End plate 98*b* is attached to shaft 92*b* by a fastener 102 which bears against a spring clutch 103. Spring clutch 103 permits rotation of sleeve 96*b* about shaft 92*b* and also permits a predetermined range of axial movement of sleeve 96*b* along shaft 92*b*.

A plurality of threaded metering rods 111, 112, 116 are threadably secured to end plate 98*b*. The metering rods 111–116 may be rotatably positioned about shafts 92*b*, and each metering rod may be threadably adjusted along the axial direction. In the position shown (see FIG. 6), metering rod 112 is in axial alignment with axis 100 and is, therefore, aligned with the end of connecting rod 71 which projects leftwardly out of air motor 80*b*. Therefore, metering rod 112 limits the axial range of travel of connecting shaft 71 by providing a stop which limits further axial movement of connecting rod 71 after contact is made to the end of metering rod 112. This also limits the range of travel of air motor 80*b*, and by extension, limits the metering stroke of pump 16*b*. Each of the respective metering rods 111–116 may be individually preset to a particular axial position thereby providing six different metering positions for controlling the output valve pump 16*b*.

A locking screw is associated with each of the metering rods 111–116 to provide a means for fixing the axial position of the metering rod. For example, lock screw 116*a* is radially aligned with the axis of metering rod 116; the lock screw 116*a* may be threadably turned into interference fit against metering rod 116, thereby preventing any further axial movement of rod 116. Other metering rods have similar lock screws 111*a*–115*a*, and all of the lock screws operate in a similar manner. Detent plate 99*b* has a indentation corresponding to each of the metering rod positions 111–116. A spring-loaded pin 120 is engageable into the respective detents to secure the rotational position of turret 90*b* and to thereby lock a particular metering rod in alignment with axis 100. Therefore, each time the metered volume of pump 16*b* is to be changed, pin 120 is withdrawn from its detent position, turret 90*b* is rotated about axis 110 until a new metering rod is axially positioned along axis 100, and pin 120 is released to engage the corresponding detent in detent plate 99*b*.

The respective axial positions of the metering rods 111–116 may be empirically determined by operating the pump 16*b* with a sample liquid and rotating the turret until each of the metering rods comes into alignment along axis 100. For each metering rod, the pump may be operated into a calibrated container; and the rod may be threadably moved along axis 100 until a predetermined and calibrated volume is delivered. With the construction as described, the container filling unit will deliver up to six different predetermined volumes into respective containers.

In operation, the calibration procedure is initially followed to properly set the respective metering rods on each of the pumping systems contained in the container filling unit. Thereafter, the container filling unit is moved into position adjacent a conveyor or holding table as shown in FIG. 2 and the containers are moved in position beneath the dispensing heads. The container filling unit may then be automatically operated to fill the predetermined volumes of liquid into containers for so long as necessary. If the volume settings are to be changed during operation, the respective turrets are revolved to place the proper metering rod in axial alignment with the air motor shaft; and the system is restarted. After the particular liquid of interest has been delivered, the container filling unit may be rolled away from the conveyor line to a cleaning area and various solvents may be flushed through the system to prepare it for its next use.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A mobile container filling unit, comprising:

a) a base frame mounted on wheels, and an upstanding support frame affixed to said base frame;

b) at least one pumping assembly attached to said base frame, each such pumping assembly further comprising a reciprocable pump having inlet and outlet check valves and having a piston rod aligned along a first axis; and a reciprocable motor having a drive rod aligned along said first axis, one end of said drive rod connected to said piston rod and the other end of said drive rod being movable outside said motor along said first axis;

c) a metering turret having a mounting shaft affixed to each said reciprocable motor and aligned along a second axis, said metering turret further comprising a cylinder rotatably mounted to said mounting shaft, said cylinder having an open end proximate said motor and a closed distal end, and having a plurality of headed metering rods aligned about a circle on said closed distal end, the radius of said circle being equal to the distance between said first and second axis, whereby said metering turret can be rotated to position each said metering rod in axial alignment with said first axis; and d) a dispensing nozzle mounted to said upstanding support frame for each at least one pumping assembly, in flow communication with an outlet check valve in said reciprocable pump.

2. The apparatus of claim 1, wherein said metering turret closed end is affixed to said mounting shaft by a spring biased fastener, whereby a limited amount of axial movement of said cylinder relative to said mounting shaft is permitted.

3. The apparatus of claim 2, further comprising a control disk mounted to said metering turret adjacent said motor, said control disk having openings aligned with said metering rods.

4. The apparatus of claim 3, further comprising a first proximity switch mounted on said motor and responsive to contact by said control disk.

5. The apparatus of claim 4, further comprising solenoid valves operable to control the direction of the stroke of each said reciprocable motor, said solenoid valves connected to and actuable by respective first proximity switches.

6. The apparatus of claim 5, further comprising a second proximity switch attached to said reciprocable motor, said second proximity switch being responsive to a predetermined stroke position of said motor, said second proximity switch connected to a respective solenoid valve.

7. The apparatus of claim 6, further comprising a plurality of tacking fasteners arranged about said metering turret cylinder, each said fastener being threadable into interference with one of said turret rods.

8. The apparatus of claim 7, further comprising a threaded positioner connected between said upstanding support frame and said dispensing nozzles, and handle means for turning said positioner to raise and lower said dispensing nozzles.

9. A mobile container filling unit, comprising:

a) a base frame mounted on wheels, an upstanding support frame affixed to said base frame, a threaded crank mounted on said upstanding support frame, and a support arm threadably attached to said threaded crank;

b) at least one liquid dispensing nozzle attached to said support arm;

c) at least one pumping assembly attached to said base frame and respectively coupled to each said at least one dispensing nozzle, each said pumping assembly comprising a reciprocable pump and motor driver, each said motor driver having a reciprocable drive rod aligned along a first axis; and d) a metering turret attached to each said motor driver and having a cylinder rotatable about a second axis parallel to and offset from said first axis, said cylinder having a closed end with a plurality of metering rods threadably adjustable therethrough and arranged about a circular path, the radius of said circular path being equal to the offset between said first and second axes, whereby each said metering rod can be alignable with said motor driver drive rod.

10. The apparatus of claim 9, further comprising solenoid valves connected to said motor driver and actuable to control the stroke direction of said motor driver; and further comprising a first proximity switch connected to detect contact between said motor driver drive rod and one of said metering rods, and a second proximity switch connected to detect a predetermined stroke position of said motor driver, both of said proximity switches connected to said solenoid valves to change motor-driver stroke position when actuated.

11. The apparatus of claim 9, wherein said metering turret cylinder is connected to said second axis by a spring-biased fastener, whereby contact between said motor driver drive rod and one of said metering rods causes a limited axial movement of said cylinder.

12. The apparatus of claim 11, further comprising a control disk connected to said cylinder and wherein said first proximity switch is positioned to be responsive to axial movement of said control disk.

13. The apparatus of claim 12, wherein said motor driver further comprises a drive piston having a circumferential magnet mounted thereon, and said second proximity switch is positioned to detect said magnet proximate one end of said motor driver stroke.

14. The apparatus of claim 13, wherein said plurality of metering rods comprises six metering rods.

15. The apparatus of claim 14, wherein each of said dispensing nozzles further comprise solenoid actuated valves, and said first and second proximity switches are respectively connected to said solenoid actuated valves.

* * * * *

UNITED STATES PATENT AND TRADEMARK OFFICE

CERTIFICATE OF CORRECTION

PATENT NO. : 5,823,406
DATED : October 20, 1998
INVENTOR(S) : Terence P. Roberts It is certified that error appears in the above-identified patent and that said Letters Patent is hereby corrected as shown below:

Column 2,
Line 42, please delete the word "charger" and insert in its place the word -- charge --.

Column 5,
Line 15, please delete the word "headed" and insert in its place the word -- threaded --.

Signed and Sealed this

Second Day of October, 2001

*Attest:*

Nicholas P. Godici

NICHOLAS P. GODICI
*Acting Director of the United States Patent and Trademark Office*

*Attesting Officer*